US006524200B2

(12) United States Patent
Kato et al.

(10) Patent No.: US 6,524,200 B2
(45) **Date of Patent: *Feb. 25, 2003**

(54) THREAD-WOUND GOLF BALL

(75) Inventors: Akira Kato, Kobe (JP); Keiji Moriyama, Kobe (JP); Satoshi Iwami, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/827,164

(22) Filed: Apr. 6, 2001

(65) Prior Publication Data

US 2001/0041631 A1 Nov. 15, 2001

(30) Foreign Application Priority Data

Apr. 7, 2000 (JP) ..... 2000-106349

(51) Int. Cl.[7] ..... A63B 37/06; A63B 37/00
(52) U.S. Cl. ..... 473/365; 473/357; 473/351
(58) Field of Search ..... 473/351–378

(56) References Cited

U.S. PATENT DOCUMENTS 4,884,814 A 12/1989 Sullivan
5,033,749 A * 7/1991 Kakiuchi et al. ..... 473/354
5,338,038 A * 8/1994 Cadorniga ..... 473/354
5,397,129 A 3/1995 Kato et al.
5,716,293 A 2/1998 Yabuki et al.
6,371,869 B1 * 4/2002 Kato et al. ..... 473/356

FOREIGN PATENT DOCUMENTS

GB A2311530 1/1997

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A thread-wound golf ball, such as a balata-covered golf ball, formed of a center 1*a*, a rubber thread layer 1*b* covering the center 1*a*, and a cover 2 is provided. The center 1*a* has an outer diameter of 28–35 mm and a Shore A hardness of 10–50. The cover 2 is formed of a mixture containing ionomer resin, thermoplastic elastomer and tackifier and has a Shore D hardness of 45–60. As such, the golf ball exhibits great carry distance with good shot feel, provides high spin rate when shot from the rough or in a raining condition, and that easily comes to a halt.

18 Claims, 1 Drawing Sheet

THREAD-WOUND GOLF BALL

BACKGROUND OF THE INVENTION

1. Field of the Invention

The present invention relates to a thread-wound golf ball with a center, a rubber thread layer covering the center, and a cover. More specifically, the present invention relates to a thread-wound golf ball that exhibits great carry distance with good shot feel and that easily comes to a halt with high spin rate when shot from the rough or when shot in the rain.

2. Description of the Background Art

The basic structure of a thread-wound golf ball includes a rubber thread layer formed by winding a rubber thread on a solid center of a solid rubber or a liquid center with a liquid covered with a rubber, and a cover formed around the rubber thread layer.

Thread-wound golf balls formed of a balata cover and a liquid center are widely used by low-handicapped golfers and professional golfers, providing excellent shot feel and controllability.

However, the structure of such golf balls are inferior to those formed of an ionomer resin cover and a solid center in flight performance, cut resistance, and durability. Further, the use of the liquid center has a disadvantage that the fabrication process is difficult and, if the ball is cut with a cutter or the like, the inside liquid may spray out. If the liquid comes into eyes, one would possibly lose one's sight.

On the contrary, a thread-wound golf ball formed of a balata cover and a solid center has advantages over that of the balata cover and the liquid center in that it is fabricated by a simple process and that it assures safety in case that the ball is damaged.

However, the golf ball of the solid center is inferior to that of the liquid center in that spin rate is so high and hitting angle is so small that carry distance is extremely reduced.

For example, U.S. Pat. No. 5,397,129 has proposed a thread-wound golf ball including a rubber thread layer formed by winding a rubber thread onto a solid rubber center of, e.g., silicone rubber, having a prescribed surface hardness and compressibility, and a cover layer formed on the rubber thread layer.

The aforementioned U.S. Patent provides for lower spin rate and greater hitting angle to achieve a prescribed carry distance.

However, the aforementioned laid-open application suffers from a problem that sufficient spin rate is not achieved when shot from the rough or in the rain, whereby a ball does not easily come to a halt.

On the other hand, U.S. Pat. No. 5,716,293 has proposed a thread-wound golf ball directed to provide a golf ball with excellent shot feel, controllability, flight performance, durability, and cut resistance. The golf ball includes a solid center formed of an inner core rubber portion containing a vulcanized rubber composition of an oily substance and a cover layer formed on the inner core rubber portion, a rubber thread layer, and a cover mainly including ionomer resin with a stiffness modulus of 70–280 MPa.

The aforementioned laid-open application provides good shot feel and increased spin rate when shot by a short iron. In addition, the use of a solid center alleviates the problem of difficult fabrication process as compared to the case of the liquid center.

However, the aforementioned invention still suffers from the problem associated with difficult fabrication process because of the center of a two-layer structure. Further, the spin rate in a wet condition is inferior to the spin rate in a dry condition. Therefore, these golf balls were not satisfactory also from the aspect of spin maintenance.

SUMMARY OF THE INVENTION

The present invention is made to solve the aforementioned problems. An object of the present invention is to provide a thread-wound golf ball, such as a balata-covered golf ball, that exhibits great carry distance with good shot feel and that can easily come to a halt with high spin rate when shot from the rough or when shot in the rain.

The above object is achieved by a golf ball of the present invention set forth in the following.

According to an aspect of the present invention, a thread-wound golf ball is constituted by a center, a rubber thread layer covering the center, and a cover. The center has a diameter of 28–35 mm and a Shore A hardness of 10–50. The cover is formed of a mixture containing ionomer resin, thermoplastic elastomer, and tackifier, and has a Shore D hardness of 45–60.

According to another aspect of the present invention, a thread-wound golf ball includes the above center, where the center is formed of a cross-linked mold mainly containing silicone rubber.

According to still another aspect of the present invention, the thermoplastic elastomer of the thread-wound golf ball contains at least one of a styrene-butadiene-styrene block copolymer (SBS structure), a modified product thereof, or a hydrogenate thereof.

According to still another aspect of the present invention, the thermoplastic elastomer of the thread-wound golf ball contains at least one of a styrene-isoprene-styrene block copolymer (SIS structure), a modified product thereof, or a hydrogenate thereof.

According to still another aspect of the present invention, the tackifier of the thread-wound golf ball contains at least one of terpene resin and rosin ester.

According to still another aspect of the present invention, the tackifier of the thread-wound golf ball has an SP value of 7.0–10.0.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
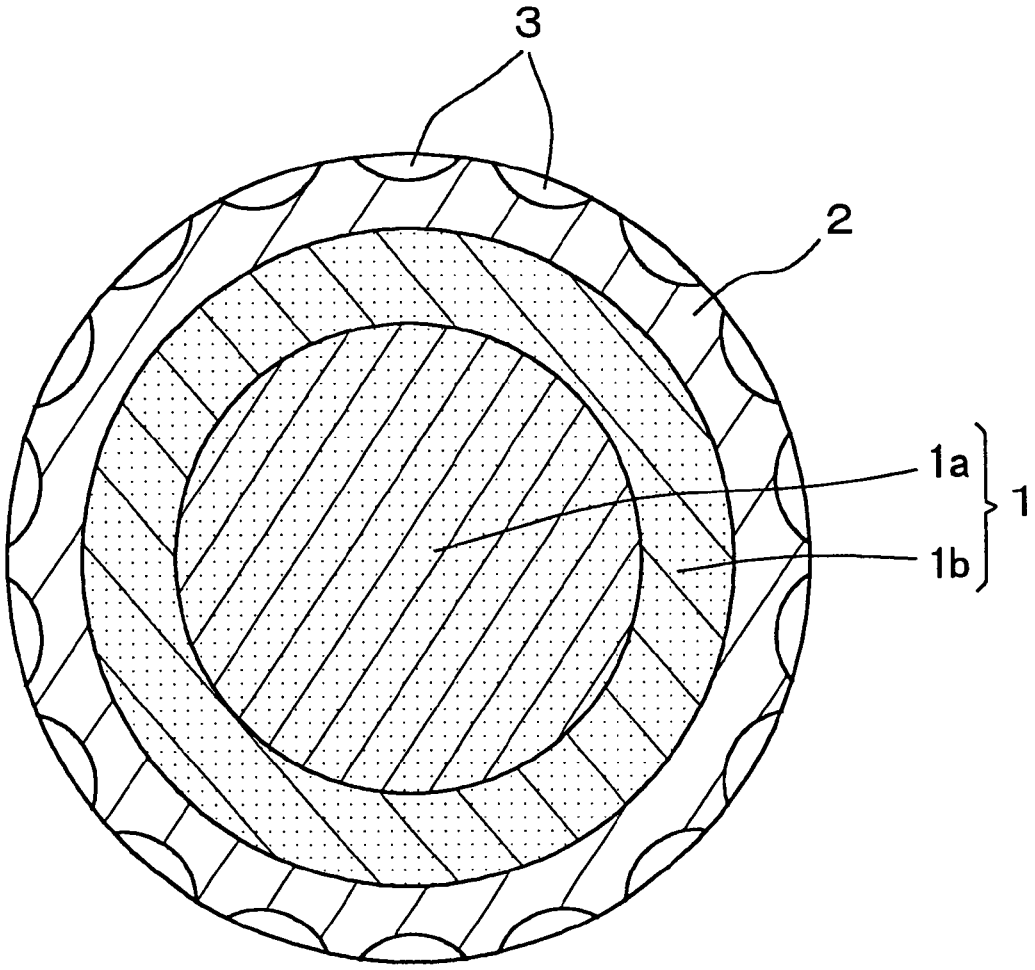
FIG. 1 is a sectional view schematically showing a golf ball according to the present invention.

The present inventors have arrived at the present invention based on the fact that a thread-wound golf ball, such as a balata-covered golf ball, formed of a center having a diameter of 28–35 mm and a Shore A hardness of 10–50, a rubber thread layer covering the center, and a cover of a mixture containing ionomer resin, thermoplastic elastomer, and tackifier and having a Shore D hardness of 45–60 exhibits great carry distance with good shot feel and can easily come to a halt with high spin rate when shot from the rough or when shot in the rain.

The thread-wound golf ball of the present invention includes a center having a Shore A hardness of 10–50. If the hardness of the center is higher than 50, the spin rate when shot becomes too high, causing upward trajectory, whereby carry distance is restrained. If the Shore A hardness is lower than 10, the center is easily deformed in winding a rubber thread onto the center, causing problems of workability and efficiency of the fabrication process. It is noted that, in order to increase carry distance and simplify the process, the center has a Shore A hardness of preferably 12–48, and more preferably 15–45.

The center of the thread-wound golf ball of the present invention has an outer diameter of 28–35 mm. If the outer diameter of the center is smaller than 28 mm, the spin rate when shot is too high, causing upward trajectory, whereby carry distance is restrained. On the other hand, if the outer diameter of the center is greater than 35 mm, the ball becomes too soft to provide an appropriate hardness. Note that the center has an outer diameter of preferably 29–34 mm, and more preferably 30–33 mm.

The cover is formed of a mixture containing ionomer resin, thermoplastic elastomer, and tackifier, so that the golf ball has an appropriate hardness while maintaining good flight performance and cut resistance. In addition, the golf ball provides appropriate adherence to a club face when shot.

The cover used for the thread-wound golf ball of the present invention has a Shore D hardness of 45–60. If the Shore D hardness is below 45, the ball becomes too soft and an initial velocity of the ball tends to be low. On the other hand, if the Shore D hardness is higher than 60, the spin rate when shot by a short iron or the like becomes low. It is noted that the cover has a Shore D hardness of preferably 47–58, and more preferably 48–56.

Preferably, the center used for the thread-wound golf ball of the present invention includes a cross-linked mold mainly containing silicone rubber. In the case of the cross-linked mold mainly containing silicone rubber, soft rubber with high bounce is easily obtained. Namely, when the center is formed of a cross-linked mold mainly containing silicone rubber, the spin rate is restrained to provide greater hitting angle, and high bounce of silicone provides greater carry distance than the conventional thread-wound ball.

For the thermoplastic elastomer contained in the cover, at least one of a styrene-butadiene-styrene block copolymer (SBS structure), a modified product thereof, and hydrogenate thereof may be used. In such a case, suitable cut resistance and controllability are obtained.

For the thermoplastic elastomer contained in the cover, at least one of a styrene-isoprene-styrene block copolymer (SIS structure), a modified product thereof, and a hydrogenate thereof may be used. In this case also, suitable cut resistance and controllability are obtained.

For the tackifier contained in the cover, at least one of terpene resin and rosin ester may be used. In this case, the tackifier can be appropriately blended with basic resin of the cover and an appropriate adherence is provided to the club face when the golf ball is shot.

If the thermoplastic elastomer contains at least one of a styrene-butadiene-styrene block copolymer (SBS structure), a modified product thereof, and hydrogenate thereof, or the thermoplastic elastomer contains at least one of a styrene-isoprene-styrene block copolymer (SIS structure), a modified product thereof, and a hydrogenate thereof, the tackifier used for the cover of the present invention suitably has an SP value of 7.0–10.0. An SP value means a solubility parameter. In these cases, the SP value 7.0–10.0 of the thermoplastic elastomer provides better solubility of the thermoplastic elastomer and tackifier. Note that the SP value of the tackifier is preferably 7.5–9.5, more preferably 8.0–9.0, and particularly preferably 8.2–8.6.

In addition, a value of "SPb-SPc" which is a difference between SPb of the SP value of the thermoplastic elastomer and SPc of the SP value of the tackifier is preferably −3 to +3, more preferably −1.5 to +1.5, and particularly preferably −1.0 to +1.0.

Note that, if at least two materials are used for the thermoplastic elastomer or the tackifier, the average value (average value of weight) of the SP values of these at least two materials may fall within the above defined ranges. More preferably, the SP values of all materials and a relationship of "SPb-SPc" may fall within the above defined ranges. This provides improved solubility as well as enhanced cut resistance and bounce.

The structure of the thread-wound golf ball of the present invention will be described with reference to FIG. 1. As shown in FIG. 1, the thread-wound golf ball of the present invention includes a thread-wound core 1 formed by winding a rubber thread layer 1*b* on a center 1*a*, and a cover 2 formed on thread-wound core 1.

Center 1*a* used for the thread-wound golf ball of the present invention is preferably a cross-linked mold mainly including silicone rubber. If the cross-linked mold mainly containing silicone rubber is used, soft rubber with high bounce is easily obtained.

The silicone rubber includes a filler, vulcanizing agent and the like, uniformly dispersed in silicone crude rubber.

Generally, the silicone crude rubber mainly contains a unit of dimethyl siloxane $(CH_3)_2SiO$ which is a colorless elastic body exhibiting some degree of flowability at room temperature, and which has on average 103 diorganosiloxane units per molecule and molecule weight is about 105–106.

The silicone crude rubber can be obtained by heating and ring-opening polymerizing with an acid or alkali cyclic dimethyl siloxane obtained by hydrolyzing dimethyl dichlorosilane. Examples of silicone crude rubber include dimethyl silicone crude rubber, methyl vinyl silicone crude rubber, and methylphenyl silicone crude rubber. For dimethyl silicone crude rubber, KE-76 from Shin-Etsu Chemical Co., Ltd., TS-959 from Toshiba Silicone, Silastic 400 and Silastic 401 from D.C., SE-76 from G.E., and W-95 from U.C.C. can be enumerated. Examples of methyl vinyl silicone crude rubber include KE-77 from Shin-Etsu Chemical Co., Ltd., TS-959B from Toshiba Silicone, SH-430 from Toray Silicone, Silastic 410 and Silastic 430 from D.C., SE-31 from G.E., and W-96 from U.C.C. Examples of methylphenyl silicone crude rubber include KE-79 from Shin-Etsu Chemical Co., Ltd., Silastic 440 from D.C., and W-97 from U.C.C.

If only silicone crude rubber is vulcanized, a pull strength tends to be low. Thus, a filler may be used to give greater strength to silicone rubber. For the filler, a reinforcing filler and non-reinforcing filler, respectively intended for reinforcement and weight increase, can be used. Note that the filler needs to be selected which exhibits excellent resistance to heat and which does not adversely affect the silicone rubber at high temperature. Examples of the reinforcing filler include finishing silica, high-purity aerosol silica, silica aerogel, and precipitated silica. As specific trade names, Valron (Estersil) of finishing silica, Aerosil or Cab-o-sil of high-purity aerosol silica, Santocel C of silica aerogel, and Hi-sil X-303 of precipitated silica can be enumerated. Examples of the non-reinforcing filler include calcined diatom earth silica, precipitated calcium carbonate, crumb silica, quartz powder, titanium oxide, and zinc oxide. As specific trade names, Celite 270, Celite Super Floss, Dicalite P.S. or Dicalite White of calcined diatom earth silica, Witearb R of precipitated calcium carbonate, Neo Novacite of crumb silica, Minu Sil of quartz powder, Titanox RA of titanium oxide, and XX-78 Oxide of zinc oxide can be enumerated.

Examples of a method of vulcanizing silicone rubber include methods using an organic peroxide, aliphatic azotized compound and radiation. The organic peroxide is used as an vulcanizing agent. Examples of organic peroxide include benzoyl peroxide, bis 2, 4 dichloro benzoyl peroxide, dicumin peroxide, and di-tertiary-butyl peroxide may be used. Preferably, the vulcanizing agent is added in an amount of 0.2–8.0 parts by weight of base rubber. If the blended amount is less than 0.2 parts by weight, vulcanization is not completely carried out, whereby sufficient hardness and bounce are not obtained. If the blended amount exceeds 8.0 parts by weight, the center becomes too hard, whereby the spin rate increases and carry distances is restrained.

Cross linking of silicone rubber may be carried out by heating, or by letting the silicone rubber stay at room temperature. There are two types of room-temperature cross linking, i.e., one-liquid cross linking where a cross-linking agent is preliminary formulated and filled in a cartridge or a tube and cross-linking is caused by condensation reaction when exposed to air, and two-liquid type cross linking where a catalytic agent is blended during use for causing cross-linking.

As described above, for silicone rubber, dimethyl silicone rubber, methyl vinyl silicone rubber, and methylphenyl vinyl silicone rubber can be used, although a copolymer thereof can also be used. Note that, dimethyl silicone rubber is used as a main component because of its high bounce, and heating-vulcanization type silicone rubber with a small amount of copolymerized methyl vinyl siloxane is preferably used. A vinyl group is preferably contained in an amount of 0.1–10 mol %, more preferably 0.15–0.8 mol %.

In the cross-linked mold, the silicone rubber is preferably blended in an amount of at least 70 parts by weight with respect to 100 parts by weight of the base rubber, and more preferably at least 80 parts by weight. If the amount of silicone rubber is too small, soft and high bounce is not assured. Examples of rubber that is combined with silicone rubber include butadiene rubber (BR), ethylene propylene rubber (EPDM), acrylic nitrile butadiene rubber (NBR), acrylic nitrile rubber (NR), and polynorbornene rubber.

Note that an oily substance may be contained to decrease hardness and provide appropriate bounce. Examples of the oily substance include alkyl benzene based oil, naphthenic oil, paraffinic oil, aromatic oil, DOA, and DOS.

A weight adjusting agent may be contained in the cross-linked mold. Examples of the weight adjusting agent include an inorganic filler and high-density metal powder. As specific examples of the inorganic filler, zinc oxide, barium sulfate, and calcium carbide can be enumerated. As specific examples of high-density metal powder, tungsten powder and molybdenum powder can be enumerated.

The weight adjusting agent is preferably added in an amount of 15–80 parts by weight with respect to 100 parts by weight of the base rubber. If the blended amount is less than 15 parts by weight, the weight of center becomes too small and the weight adjusting agent must be added in a large amount to the other rubber thread or cover. As a result, the bounce of the ball is reduced. If the blended amount exceeds 80 parts by weight, on the other hand, the weight of the center is too large and the ball does not have an appropriate weight.

If center 1*a* is formed of silicone rubber, a vulcanizing agent in an amount of 0.5–5 parts by weight as well as a desirable amount of weight adjusting agent are blended by Banbury mixer or a roll, which is then vulcanized and molded for 10–20 minutes at 150–170° C.

It is noted that, although any usual vulcanizing agent and weight adjusting agent may be employed, a weight adjusting agent with high relative density is suitable.

A rubber thread for a golf ball is wound around center 1*a* to form a thread-wound center 1 including center 1*a* and rubber thread layer 1*b*. The rubber thread wound around center 1*a* may be of the material conventionally used for the thread wound layer 1*b* of a thread-wound golf ball such as natural rubber or a vulcanized rubber composition having sulfur, a vulcanization aid, a vulcanization accelerator, an antioxidant or the like blended with natural rubber and synthesis polyisoprene. Rubber thread layer 1*b* can be wound on the solid core with the conventional method of fabricating a thread-wound core of a thread-wound golf ball. The thickness of rubber thread layer 1*b* is 1.5–7.5 mm, preferably 2.0–7.0 mm. If the thickness thereof is smaller than 1.5 mm, the bounce of the rubber thread is not effected. If the thickness is greater than 7.5 mm, the spin rate when shot is increased to exhibit a highly upward trajectory, whereby the flight distance is reduced. Cover 2 is formed on the obtained rubber thread layer 1*b*.

In the present invention, the ionomer resin employed as the basic resin of the cover is, for example, a binary copolymer of α-olefin and α, β-unsaturated carboxylic acid having 3–8 carbon atoms, obtained by neutralizing at least a portion of the carboxyl group thereof with metallic ion. Alternatively, a ternary copolymer of α-olefin, α, β-unsaturated carboxylic acid having 3–8 carbon atoms, and α, β-unsaturated carboxylic acid ester having 2–22 carbon atoms, obtained by neutralizing at least a portion of the carboxyl group thereof with metallic ion can be employed.

As to the composition ratio, 80–90% by weight of α-olefin and 10–20% by weight of α, β-unsaturated carboxylic acid are preferable when the base polymer of the ionomer resin is a binary copolymer of α-olefin and α, β-unsaturated carboxylic acid having 3–8 carbon atoms. When the base polymer is a ternary copolymer of α-olefin, α, β-unsaturated carboxylic acid having 3–8 carbon atoms and α, β-unsaturated carboxylic acid ester having 2–22 carbon atoms, 70–85% by weight of α-olefin, 5–20% by weight of α, β-unsaturated carboxylic acid and 10–25% by weight of α, β-unsaturated carboxylic acid ester are preferable. It is also preferable that the melt index (MI) of these ionomer resins is 0.1–20, particularly 0.5–15.

As the α-olefin, ethylene, propylene, 1-butene, 1-pentene, for example, are employed, where ethylene is particularly preferable. As the α, β-unsaturated carboxylic acid having 3–8 carbon atoms, acrylic acid, methacrylic acid, fumaric acid, maleic acid, crotonic acid, for example, are employed, with acrylic acid and methacrylic acid being particularly preferable. As the unsaturated carboxylic acid ester, methyl, ethyl, propyl, n-butyl, isobutyl ester or the like of acrylic acid, methacrylic acid, fumaric acid, maleic acid or the like, for example, are employed, with acrylic acid ester and methacrylic acid ester being particularly preferable. As the metallic ion neutralizing at least a portion of the carboxyl group in the foregoing copolymer of α-olefin and α, β-unsaturated carboxylic acid or the foregoing ternary copolymer of α-olefin, α, β-unsaturated carboxylic acid and α, β-unsaturated carboxylic acid ester, sodium ion, lithium ion, zinc ion, magnesium ion, potassium ion, for example, can be enumerated. When the ionomer resin has at least a portion of the carboxyl group in the copolymer of ethylene and acrylic acid or methacrylic acid neutralized with metallic ions, the highly rigid and high flow type having a melt index of 3–7 and a flexural modulus of 200–400 MPa is preferable.

Specific trade names of the ionomer resin are enumerated in the following. Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg), and Hi-milan MK7320 (K) sold by Mitsui-DuPont Polychemical Co., Ltd. are available. As the ternary copolymer ionomer resin, Hi-milan 1856 (Na), Hi-milan 1855 (Zn), and Hi-milan AM7316 (Zn) are available from Mitsui-DuPont Polychemical Co., Ltd. As ionomer resins sold by DuPont Co. are available Surlyn 8945 (Na), Surlyn 8940 (Na), Surlyn 8945 (Na), Surlyn 9910 (Zn), Surlyn 9945 (Zn), Surlyn 7930 (Li), and Surlyn 7940 (Li)7 are available. As the ternary copolymer type ionomer resin, Surlyn AD8265 (Na) and Surlyn AD8269 (Na) are available from DuPont Co.

As ionomer resins available from Exxon Chemical Japan Ltd., lotek 7010 (Zn), lotek 8000 (Na) and the like are available. Na, Zn, K, Li, Mg and the like in the above parenthesis following respective trade names of the ionomer resin indicate the metal type of these neutral metallic ions. In the present invention, the ionomer resin employed in the basic resin of the cover may have at least two of those enumerated above can be mixed. Alternatively, at least two types of the ionomer resin neutralized with monovalent metallic ions enumerated above and ionomer resin neutralized with divalent metallic ions can be mixed to be used.

The basic resin of the cover of the present invention has at least one type of thermoplastic elastomer with a soft segment and a hard segment mixed into the ionomer resin. As the thermoplastic elastomer, the materials of each type used for the external layer core can be employed. Particularly, a block copolymer having a conjugated diene compound such as butadiene block or isoprene block is particularly suitable. As the conjugated diene compound, one or at least two types can be selected from, for example, butadiene, isoprene, 1,3-pentadiene, 2,3-dimethyl-1,3-butadiene. Particularly, butadiene, isoprene, and a combination thereof are preferable. As a component forming other block copolymers, one or at least two types can be selected from styrene, α-methyl styrene, vinyl toluene, p-3 butyl styrene, 1,1-diphenyl ethylene, where styrene being preferable.

As specific examples of block copolymers, styrene-butadiene-styrene block copolymer (SBS structure), styrene-ethylene-butylene-styrene block copolymer (SEBS structure), styrene-isoprene-styrene block copolymer (SIS structure), styrene-ethylene-propylene-styrene block copolymer (SEPS structure), and a modified product thereof can be enumerated.

The content of styrene of the foregoing SBS structure, SEBS structure, SIS structure and SEPS structure (or an alternative monomer) is in the range of 10–50% by weight, particularly 15–45% by weight in the copolymer. If the content is less than 10% by weight, the cover will become so soft that the cut resistance is degraded. If the content is greater than 50% by weight, the ionomer resin cannot be softened sufficiently to degrade the shot feel and controllability.

In the present invention, an epoxy group can be included as a part of the copolymer of the foregoing SBS, SEBS, SIS and SEPS structure.

For example, the styrene-butadiene-styrene block copolymer (SBS structure) including a polybutadiene block with an epoxy group is a block copolymer having polystyrene at both terminals with an intermediate chain of polybutadiene containing the epoxy group, where a portion or all of the double bond of the polybutadiene portion is hydrogenated. The styrene-isoprene-styrene block copolymer having a polyisoprene block containing an epoxy group (SIS structure) is a block copolymer having polystyrene at both terminals with an intermediate chain of polyisoprene containing the epoxy group, where a portion or all of the double bond of the polyisoprene portion is hydrogenated.

The content of the epoxy group in the block copolymer of the epoxidized SBS structure or SIS structure is 0.05–10% by weight, particularly 0.2–5% by weight. If the content of the epoxy group is smaller than 0.05% by weight, reaction between the epoxy group and the free carboxyl group in the ionomer resin is reduced to degrade the dispersion of the block copolymer of the epoxidized SBS structure or SIS structure in the ionomer resin. There is a possibility that the durability is degraded. If the content of epoxy is larger than 10% by weight, reaction between the epoxy group and the free carboxyl group in the ionomer resin becomes excessive to degrade the flowability. There is a possibility that ball-molding becomes difficult.

As products of the block copolymer of the epoxidized SBS structure or SIS structure available on the market, the styrene-butadiene-styrene block copolymer including a polybutadiene block containing an epoxy group (SBS structure) sold under the trade name of ESBS A1010 from Daicel Chemical Industries Ltd., and the styrene-butadiene-styrene block copolymer corresponding to a hydrogenated portion of a polybutadiene block including an epoxy group sold under the trade name of ESBS AT018 and ESBS AT019 from Daicel Chemical Industries Ltd. can be enumerated. All of these products are suitable in the present invention.

As a product of a block copolymer of the SEBS or SEPS structure having a hydroxyl group added to the terminal available on the market, Septon HG-252 from Kuraray Co., Ltd., for example, is available.

In the present invention, the mixing ratio of the ionomer resin to the thermoplastic elastomer such as the block copolymer of the SBS or SIS structure is 95:5–30:70, particularly 80:20–40:60 in weight ratio. If the amount of the ionomer resin exceeds the foregoing range, the ionomer resin cannot be softened sufficiently. The property of ionomer resin will be exhibited too strongly so that the shot feel or controllability will be degraded. If the amount of the ionomer resin is lower than the foregoing range, the cover will become too soft to increase the spin rate. As a result, there is a possibility that the carry distance is reduced and the cut resistance degraded.

In the present invention, the desired cover characteristics can be obtained by heating and mixing the foregoing ionomer resin with the thermoplastic elastomer of the SBS or SIS structure. The heat-mixing process is carried out at, for example, 150–260° C. using an internal mixer such as the general two-shaft kneading type extruder, Banbury, kneader, or the like.

The tackifier employed in the cover 2 of the present invention includes coumarone-indene based resin, terpene based resin, rosin derivative, phenol-formaldehyde based resin, alkyl phenol based resin, petroleum based resin, xylene-formaldehyde based resin, oligomer of polybutene, liquid rubber such as liquid polyisoprene and the like. Particularly, terpene resin and rosin ester based resin are preferably applicable.

The foregoing terpene resin is a terpene polymer and a polymer with a polymer chain as the second component, including the terpene resin whose basic structure is shown by the following general formula (1), styrene based terpene resin whose basic structure is shown by the following general formula (2), phenol modified terpene resin whose basic structure is shown by the following general formula (3), and hydrogenated terpene resin thereof.

Formula (1)

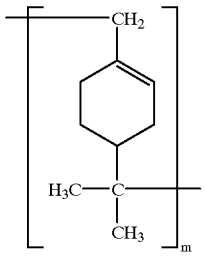

Formula (2)

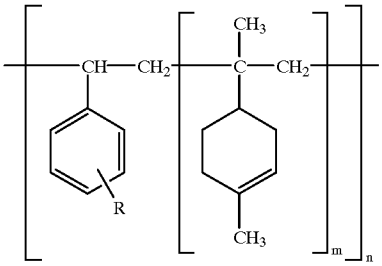

Formula (3)

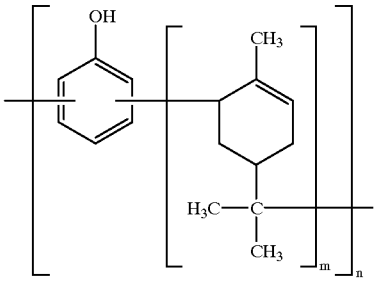

In the above formulas of (1)–(3), m and n are integers.

The terpene resin can be obtained by polymerizing terpene oil from a tree of a pine genus. Specifically, α-pinene, β-pinene campher, dipentene or the like may be used.

The rosin derivative can be obtained by hydrogenating, dimerizing, or esterificating the rosin contained in raw pine rosin, tall oil or he like. The rosin ester used in the present invention contains a hydrogenate thereof. Specifically, pentaerythritol ester, glycerine ester, hydrogenated rosin ester, hydrogenated rosin methyl ester, hydrogenated rosin ethylene glycol ester, hydrogenated rosin methyl pentaerythritol ester, hydrogenated rosin ester emulsion or the like may be used.

Specific trade names of the tackifier are set forth in the following. As the coumarone resin, Process Resin A81, Process Resin AC5, and Process Resin TX from Kobe Oil Chemical Industry Co., Ltd., Coumarone CL from Ouchishinko Chemical Industries Ltd., and coumarone resin NG4 from Nippon Steel Chemical Industries Ltd. are available. As the terpene-phenol resin, Tackirol 101, Tackirol 160, Tackirol EP20, and Tackirol EP30 from Sumitomo Chemical Co., Ltd., and Sumilight resin PR19900 from Sumitomo Dulez Co., Ltd. are available.

As the petroleum based resin, hydrogenated terpene resin Clearon P105 from Yasuhara Chemical Co., Ltd., Arkon P90 and Ester gum H from Arakawa Chemical Industries Ltd., Petroresin #80 and Hilets G100X from Mitsui Petrochemical Industries Ltd. are available.

As the rosin derivative, Nikanol A70 from Mitsubishi Gas Chemical Co., Inc., Lignol R70 from Libnite, and rosin ester resin from Arakawa Chemical Industries Ltd. are available.

The foregoing tackifier is mixed in a dispersed manner in the basic resin of the cover to provide appropriate adherence to the cover. Accordingly, the adherence on the club face is improved when hitting the golf ball. To this end, 5–50 parts by weight, preferably 10–40 parts by weight, particularly preferably 20–30 parts by weight of the tackifier is blended with respect to 100 parts by weight of the basic resin material of the cover (including thermoplastic elastomer). If the blended amount is less than 5 parts by weight, sufficient adherence cannot be provided to the cover. If the blended amount exceeds 50 parts by weight, there is a tendency of degradation in the cover's basic characteristics of hardness, feeling and durability.

In the present invention, the blending ratio of the ionomer resin, the thermoplastic elastomer, and the tackifier is preferably 30–70/20–60/10–30 with respect to 100 parts by weight of the total of the three components. If the blended amount of the ionomer resin is too small, the hardness becomes so low that the rebounce is degraded. If the blended amount of the ionomer resin is too large, the spin maintenance is reduced. If the blended amount of the thermoplastic elastomer is too small, the effect of the tackifier is not easily produced. As a result, the spin maintenance is reduced. If the blended amount of the thermoplastic elastomer is too large, the hardness will be too low.

Cover 2 of the present invention has a Shore D hardness of 45–60, preferably 47–58, more preferably 48–56 in the state covering the thread-wound center, i.e. the cover hardness. If the Shore D hardness is less than 45, the ball will become too soft, so that the initial velocity of the ball will be low. If the hardness exceeds 60, the spin rate when shot using a short iron or the like will be reduced. Here, the Shore D hardness is measured according to ASTMD-2240.

The composition of the cover in the present invention can include, if necessary, in addition to the foregoing resin corresponding to the main component, a filler such as barium sulfate or a pigment such as titanium dioxide, and also other additives such as a dispersion, an antioxidant, an ultraviolet absorber, photo-stabilizer, a fluorescent material or a fluorescent brightening agent, provided that the amount thereof is within the range that does not deteriorate the desired characteristics of the golf ball cover. In general, the blended amount of the pigment is preferably 1.0–6.0 parts by weight.

Cover 2 of the present invention can be formed by the well-known method. The cover composition is formed in advance into a hemispherical-shaped half shell. Two thereof enclose the thread wound center, followed by a molding process with pressure at 130–170° C. for 1–5 minutes. Alternatively, the cover composition can be injection-molded directly on the thread wound center to enclose the same. Cover 2 has a thickness of 1.0–3.0 mm, preferably 1.2–2.5 mm. If the thickness thereof is smaller than 1.0 mm, there is a disadvantage that the cover easily cracks when hit repeatedly. If the thickness of cover 2 is greater than 3.0 mm, the hit feeling is deteriorated. Also, a plurality of dimples 4 are formed as necessary on the surface during the cover molding process. For the purpose of improving the aesthetic appearance to raise the commercial value, the golf ball of the present invention is generally applied with paint and stamped with marking to be provided on the market.

The cover of the present invention can be formed of one layer or a plurality of layers.

The present invention will be described according embodiments.

Solid center 1*a* having a composition shown in Table 1 is fabricated and rubber thread having basic rubber of the blend of natural rubberflow cis isoprene rubber=50/50 (weight ratio) was wound around the foregoing solid center to produce a thread wound core 1 of 39.0 mm in outer diameter.

The blend materials shown in Table 2 were mixed using a two-shaft extruder to obtain cover compositions in the form of pellets. The conditions of extrusion were as follows.

Screw diameter: 45 mm

Screw rotating speed: 200 rpm

Screw L/D: 35 the blended compound was heated to 160–230° C. at the position of the die in the extruder.

Then, a hemispherical half shell was molded. Two thereof were used to enclose the obtained foregoing thread wound center 1. Press formation was applied within the mold for a ball. Paint was applied on the surface to produce a thread-wound golf ball having the outer diameter of 42.8 mm and weight of 45.3 g.

The number 1 wood (W#1) club (New Breed Tour Forged 10.5°, S shaft: Sumitomo Rubber Industries, Ltd.) was attached to the swing robot of True temper. The golf ball was hit at the head speed of 45 m/second. The ball initial velocity, spin rate and carry (the flight distance up to the drop point) were measured.

The spin rate was measured with a sandwedge club (DP-601, S shaft) attached to the swing robot of True temper. The golf ball was hit at the head speed of 20 m/second to obtain the spin rate under a normal dry condition and a wet condition using the club face wetted with water. Note that the spin maintenance is defined as (spin rate under wet condition)/(spin rate under dry condition)×100.

The golf balls were actually shot by ten professional golfers to obtain assessment. The determination criteria are as follows.

○: at least eight out of the ten professional golfers expressed favorable soft feeling.

xH: at least eight out of the ten professional golfers expressed unsatisfactory hard hit feeling.

XS: at least eight out of the ten professional golfers expressed unsatisfactory soft felling.

The tested results of the golf balls of Examples 1–5 and Comparative Examples 1–4 are shown in Table 3.

TABLE 1

| Ingredient | A | B | C | D | E | F | G | H |
|---|---|---|---|---|---|---|---|---|
| X30-2812U ·※·1 | 100 | | | | | | | |
| KE530-U ·※·2 | | 100 | | 90 | 100 | 100 | | |
| KE540-U ·※·3 | | | 100 | | | | | |
| EP86 ·※·4 | | | | 10 | | | | |
| BR11 ·※·5 | | | | | | | 100 | |
| Norsolex ·※·6 | | | | | | | | 100 |
| Sunsen 255ZJ oil ·※·7 | | | | | | | | 120 |
| Zinc oxide | | | | | | | 5 | 5 |
| Stearic acid | | | | | | | 1 | 2 |
| Barium sulfate | 66 | 44 | 30 | 48 | 71 | 14 | 57 | 190 |
| Sulfur | | | | | | | 10 | 2 |
| C-4 ·※·8 | | 4 | 4 | 4 | 4 | 4 | | |
| C-17 ·※·9 | 0.6 | | | | | | | |
| Nocceler-CZ ·※·10 | | | | | | | 1.5 | |
| Nocceler-TT ·※·11 | | | | | | | 0.2 | 0.8 |
| Nocceler-M ·※·12 | | | | | | | | 0.8 |
| Nocceler-TBT-N ·※·13 | | | | | | | | 1.2 |
| Nocceler-TE-G ·※·14 | | | | | | | | 0.4 |
| Center diameter (mm) | 28.0 | 30.0 | 32.0 | 30.0 | 27.0 | 36.0 | 32.0 | 30.0 |
| Center weight (g) | 17.8 | 20.5 | 23.2 | 20.6 | 16.7 | 30.0 | 23.2 | 20.5 |
| Center hardness (Shore A) | 24 | 36 | 43 | 38 | 37 | 35 | 75 | 43 |

·※·1: Silicone compound from Shin-Etsu Chemical Co., Ltd.
·※·2: Silicone compound from Shin-Etsu Chemical Co., Ltd.
·※·3: Silicone compound from Shin-Etsu Chemical Co., Ltd.
·※·4: EPDM from JSR Co., Ltd.
·※·5: High-cis-polybutadiene from JSR Co., Ltd.
·※·6: Polynorbornene rubber from Nippon Zeon Co., Ltd.
·※·7: Naphthene oil from Nihon Sun Sekiyu Co., Ltd.
·※·8: Vulcanization accelerator from Shin-Etsu Chemical Co., Ltd., containing di-tertiary-butyl peroxide by about 20%.
·※·9: Vulcanization accelerator from Shin-Etsu Chemical Co., Ltd., containing 1,1-bis(tertiary-butyl peroxy)-3,3,5-trimethyl cyclohexane by about 60%.
·※·10: Vulcanization accelerator from Ohuchi Shinko Kagaku Kogyo Co., Ltd., N-cyclohexyl-2-benzothiazyl sulfenamide
·※·11: Vulcanization accelerator from Ohuchi Shinko Kagaku Kogyo Co., Ltd., Tetramethylthiuram disulfide
·※·12: Vulcanization accelerator from Ohuchi Shinko Kagaku Kogyo Co., Ltd., 2-Mercaptobenzothiazole
·※·13: Vulcanization accelerator from Ohuchi Shinko Kagaku Kogyo Co., Ltd., Tetrabutylthiuram disulfide
·※·14: Vulcanization accelerator from Ohuchi Shinko Kagaku Kogyo Co., Ltd., Diethyl tellurium dithiocarbamate

TABLE 2

| Blend | I | II | III |
|---|---|---|---|
| Surlyn 9945 ※15 | 25 | 25 | 20 |
| Surlyn 8945 ※16 | 25 | 25 | 20 |
| Epofriend A1010 ※17 | 15 | 15 | 20 |
| Septon HG-252 ※18 | 35 | 35 | 40 |
| Clearon P105 ※19 | 20 | | |
| Ester gum H ※20 | | 20 | |
| Titanium dioxide | 2 | 2 | 2 |
| Barium sulfate | 2 | 2 | 2 |

※15: Ethylene-methacrylic acid copolymer ionomer resin obtained by neutralizing with a zinc ion, manufactured by Du Pont Co.
※16: Ethylene-methacrylic acid copolymer ionomer resin obtained by neutralizing with a sodium ion, manufactured by Du Pont Co.
※17: Block copolymer of SBS structure including polybutadiene block containing epoxy group from Daicel Chemical Industries, Ltd., S.P.value 9.4
※18: Block polymer of hydrogenated styrene-isoprene-styrene block copolymer with —OH group added to chainterminal from Kuraray Co., Ltd., S.P.value 7.6.
※19: Hydrogenated terpene resin from Yasuhara Chemical Co., Ltd., S.P.value 8.4.
※20: Hydrogenated rosin ester resin from Arakawa Chemical Industries, S.P.value 8.5.

fabricated by a relatively simply process because of its one-layer center.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thread-wound golf ball, comprising:

a center;

a rubber thread layer covering said center; and a cover, said center having a diameter of 28–35 mm and a Shore A hardness of 10–50, and said cover being formed of a mixture including ionomer resin, thermoplastic elastomer and tackifier and having a Shore D hardness of 45–60.

2. The thread-wound golf ball according to claim 1, wherein said center is a cross-linked mold mainly including silicone rubber.

3. The golf ball according to claim 2, wherein the silicone rubber is at least one selected from the group consisting of dimethyl silicone rubber, methyl vinyl silicone rubber and methylphenyl silicone rubber.

TABLE 3

| | | Embodiments | | | | | Comparative examples | | | |
|---|---|---|---|---|---|---|---|---|---|---|
| | | 1 | 2 | 3 | 4 | 5 | 1 | 2 | 3 | 4 |
| Center | Blend | A | B | C | D | H | E | F | G | B |
| | Diameter (mm) | 28.0 | 30.0 | 32.0 | 30.0 | 30.0 | 27.0 | 36.0 | 32.0 | 30.0 |
| | Weight (g) | 17.8 | 20.5 | 23.2 | 20.6 | 20.5 | 16.7 | 30.0 | 23.2 | 20.5 |
| | Hardness (Shore A) | 24 | 36 | 43 | 38 | 43 | 37 | 35 | 75 | 36 |
| Cover | Blend | I | I | II | I | I | I | I | I | III |
| | Hardness (Shore D) | 49 | 49 | 49 | 49 | 49 | 49 | 49 | 49 | 52 |
| | Wood No. 1 45 m/s | | | | | | | | | |
| | Initial speed of ball (m/s) | 64.6 | 64.3 | 64.2 | 64.1 | 64.0 | 64.7 | 63.8 | 64.4 | 64.5 |
| | Spin (rpm) | 2900 | 2820 | 2750 | 2950 | 2870 | 3230 | 2580 | 3300 | 2800 |
| | Carry (yard) | 205.5 | 208.0 | 209.5 | 206.5 | 204.0 | 198.5 | 200.0 | 197.0 | 209.0 |
| | SW 20 m/s | | | | | | | | | |
| | (1) Spin under dry condition (rpm) | 6750 | 6710 | 6680 | 6730 | 6690 | 6900 | 6450 | 7020 | 6700 |
| | (2) Spin under wet condition (rpm) | 3980 | 3920 | 3860 | 3920 | 3890 | 4100 | 3680 | 4210 | 3010 |
| | (3) Spin maintenance (%) | 59.0 | 58.4 | 57.8 | 58.2 | 58.1 | 59.4 | 57.1 | 60.0 | 44.9 |
| | Shot feel | ○ | ○ | ○ | ○ | ○ | ○ | XS | XH | ○ |

It is appreciated that the golf balls of the present invention are superior than the golf balls of the Comparative Examples in flight distance, spin maintenance, and hit feeling. The golf balls of Examples 1–5 all exhibit a spin maintenance of 57.8 or higher, and easily come to a halt with a large spin rate when shot in the rain.

On the other hand, the golf ball of Comparative Example 1 exhibits an upward trajectory with large spin rate when shot because of its small diameter, whereby a flight distance is restrained. The golf ball of Comparative Example 2 is too soft because of its large diameter to provide a proper ball hardness and spin rate. The golf ball of Comparative Example 3 exhibits an upward trajectory by a large spin amount when shot because of high Shore A hardness, whereby the flight distance is restrained. The golf ball of Comparative Example 4 exhibits low spin maintenance since a tackifier is not blended in the cover.

The present invention provides a thread-wound golf ball, such as a balata-covered golf ball, that exhibits favorable shot feel with great carry distance and that easily comes to a halt even though exhibiting high spinning when shot from the rough or in the rain. In addition, such a golf ball can be

4. The golf ball according to claim 2, wherein the silicone rubber contains 0.1–10 mol% of vinyl groups.

5. The golf ball according to claim 2, wherein the silicone rubber is blended in at least 70 parts by weight with a material selected from the group consisting of butadiene rubber, ethylene propylene rubber, acrylic nitrile butadiene rubber, acrylic nitrile rubber and polynorbornene rubber.

6. The thread-wound golf ball according to claim 1, wherein said thermoplastic elastomer includes at least one of styrene-butadiene-styrene block copolymer (SBS structure), a modified product thereof, and a hydrogenate thereof.

7. The thread-wound golf ball according to claim 6, wherein said tackifier has an SP value of 7.0–10.0.

8. The thread-wound golf ball according to claim 1, wherein said thermoplastic elastomer includes at least one of styrene-isoprene-styrene block copolymer (SIS structure), a modified product thereof, and a hydrogenate thereof.

9. The thread-wound golf ball according to claim 8, wherein said tackifier has an SP value of 7.0–10.0.

10. The thread-wound golf ball according to claim 1, wherein said tackifier includes at least one of terpene resin and rosin resin.

11. The golf ball according to claim 1, wherein the ionomer resin is a binary copolymer of α-olefin and α,β-unsaturated carboxylic acid having 3–8 carbon atoms, obtained by neutralizing at least a portion of the carboxylic group with metal ions.

12. The golf ball according to claim 11, wherein the metal ions are ions of Na, Zn, K, Li or Mg.

13. The golf ball according to claim 1, wherein the ionomer resin is a ternary copolymer of α-olefin, α,β-unsaturated carboxylic acid having 3–8 carbon atoms, and α,β-unsaturated carboxylic acid ester having 2–22 carbon atoms, obtained by neutralizing at least a portion of the carboxylic group with metal ions.

14. The golf ball according to claim 13, wherein the metal ions are ions of Na, Zn, K, Li or Mg.

15. The golf ball according to claim 1, wherein the tackifier is a material selected from the group consisting of coumarone-indene resin, terpene resin, rosin derivative, phenol-formaldehyde resin, alkyl phenol resin, petroleum resin, xylene-formaldehyde resin, polybutene oligomer, and liquid polyisoprene.

16. The golf ball according to claim 1, wherein the tackifier comprises a terpene resin comprising the following structure:

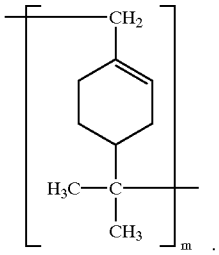

17. The golf ball according to claim 1, wherein the tackifier comprises a terpene resin comprising the following structure:

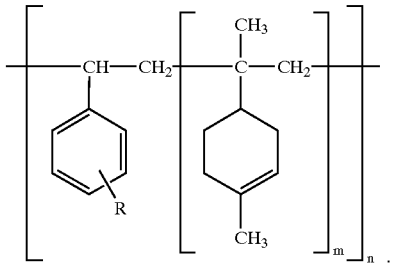

18. The golf ball according to claim 1, wherein the tackifier comprises a terpene resin comprising the following structure:

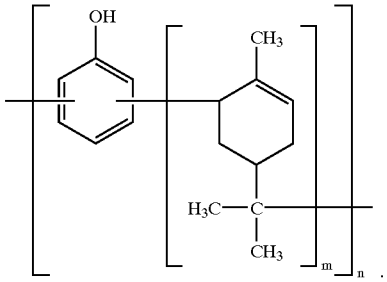

* * * * *